US011569053B2

(12) United States Patent
Hsiao et al.

(10) Patent No.: US 11,569,053 B2
(45) Date of Patent: Jan. 31, 2023

(54) FUSE RESISTOR AND METHOD FOR MANUFACTURING THE SAME

(71) Applicant: YAGEO CORPORATION, Kaohsiung (TW)

(72) Inventors: Shen-Li Hsiao, Kaohsiung (TW); Hwan-Wen Lee, Kaohsiung (TW)

(73) Assignee: YAGEO CORPORATION, Kaohsiung (TW)

( * ) Notice: Subject to any disclaimer, the term of this patent is extended or adjusted under 35 U.S.C. 154(b) by 98 days.

(21) Appl. No.: 17/306,952

(22) Filed: May 4, 2021

(65) Prior Publication Data

US 2022/0223363 A1 Jul. 14, 2022

(30) Foreign Application Priority Data

Jan. 12, 2021 (CN) ..... 202110035776.7

(51) Int. Cl.

| | |
|---|---|
| ***H01H 85/175*** | (2006.01) |
| ***H01H 69/02*** | (2006.01) |
| ***H01H 85/048*** | (2006.01) |
| *H01H 85/143* | (2006.01) |
| *H01H 85/10* | (2006.01) |

(52) U.S. Cl.

CPC ..... *H01H 85/175* (2013.01); *H01H 69/02* (2013.01); *H01H 85/048* (2013.01); *H01H 85/10* (2013.01); *H01H 85/143* (2013.01)

(58) Field of Classification Search

CPC .... H01H 69/02; H01H 85/175; H01H 85/048; H01H 85/10; H01H 85/143

USPC ..... 29/623

See application file for complete search history.

(56) References Cited

U.S. PATENT DOCUMENTS

2017/0244223 A1* 8/2017 Yasunaka ..... H01T 21/00

FOREIGN PATENT DOCUMENTS

| | | | |
|---|---|---|---|
| CN | 101261914 A | * | 9/2008 |
| CN | 101261914 A | | 9/2008 |
| JP | 4408582 B2 | * | 2/2010 |
| TW | 200903767 A | | 1/2009 |
| TW | 200929310 A | | 7/2009 |
| TW | 201621952 A | | 6/2016 |
| TW | 201933409 A | | 8/2019 |
| TW | I711066 B | | 11/2020 |

* cited by examiner

*Primary Examiner* — Kevin J Comber

(74) *Attorney, Agent, or Firm* — CKC & Partners Co., LLC

(57) ABSTRACT

A fuse resistor includes a substrate, an insulation layer, a fuse element, a protection layer, a first electrode, and a second electrode. The insulation layer covers a surface of the substrate. The fuse element is disposed on a portion of the insulation layer. The fuse element includes a first electrode portion, a melting portion, and a second electrode portion, in which the first electrode portion and the second electrode portion are respectively connected to two opposite ends of the melting portion. The protection layer covers the fuse element and the insulation layer, in which the protection layer has a cavity located on the melting portion. The first electrode is electrically connected to the first electrode portion. The second electrode is electrically connected to the second electrode portion.

5 Claims, 8 Drawing Sheets

FUSE RESISTOR AND METHOD FOR MANUFACTURING THE SAME

RELATED APPLICATIONS

This application claims priority to China Application Serial Number 202110035776.7, filed Jan. 12, 2021, which is herein incorporated by reference.

BACKGROUND

Field of Invention

The present disclosure relates to a technique for manufacturing a resistor, and more particularly, to a fuse resistor and a method for manufacturing the same.

Description of Related Art

As electric devices' demand for current is increasing, damage to valuable components on electric circuits, which may be caused by high current, gets more attention. Thus, demand for fast response fuse devices, i.e. fast blown fuse devices, is getting higher to benefit the protecting of important devices on the electric circuits. When 10 times rated current is applied to a fast blown fuse resistor, the fuse can be blown in 1 ms to protect the valuable components on the back end.

However, it is sufficient to blow the fuse device by applying high current in a very short time, but the blowing method which applies high current in a short time causes a situation similar to blasting, thus resulting in spark leakage and residue splashing. Accordingly, peripheral devices are affected to damage or destroy products.

SUMMARY

Therefore, one objective of the present disclosure is to provide a fuse resistor and a method for manufacturing the same, in which a protection layer covering a fuse element has a cavity on a melting portion of the fuse element, such that a fusing speed of the fuse element is increased to effectively protect other electronic devices on a circuit board.

Another objective of the present disclosure is to provide a fuse resistor and a method for manufacturing the same, in which there is a hollow air chamber between the melting portion of the fuse element and the protection layer, such that splashing of spark and/or residues generated during a rapid fusing process of the melting portion can be confined to prevent peripheral devices from being affected and damaged during rapid fusing.

According to the aforementioned objectives, the present disclosure provides a fuse resistor. The fuse resistor includes a substrate, an insulation layer, a fuse element, a protection layer, a first electrode, and a second electrode. The insulation layer covers a surface of the substrate. The fuse element is disposed on a portion of the insulation layer. The fuse element includes a first electrode portion, a melting portion, and a second electrode portion, and the first electrode portion and the second electrode portion are respectively connected to two opposite ends of the melting portion. The protection layer covers the fuse element and the insulation layer, in which the protection layer has a cavity located on the melting portion. The first electrode is electrically connected to the first electrode portion. The second electrode is electrically connected to the second electrode portion.

According to one embodiment of the present disclosure, the fuse element is an H-shaped structure, and a width of the melting portion is smaller than a width of the first electrode portion and a width of the second electrode portion.

According to one embodiment of the present disclosure, thermal conductivity coefficients of the insulation layer and the protection layer are equal to or smaller than 0.2 W/m K.

According to one embodiment of the present disclosure, materials of the insulation layer and the protection layer include epoxy.

According to one embodiment of the present disclosure, the protection layer includes a first insulation film and a second insulation film. The first insulation film covers the fuse element and the insulation layer. The cavity passes through the first insulation film to expose the melting portion. The second insulation film covers the first insulation film and shelters the cavity.

According to one embodiment of the present disclosure, each of the first insulation film and the second insulation film includes a dry film layer.

According to one embodiment of the present disclosure, the first electrode at least covers a side surface of the first electrode portion and a first side surface of the substrate. The second electrode at least covers a side surface of the second electrode portion and a second side surface of the substrate. The first side surface and the second side surface are respectively located on two opposite sides of the substrate.

According to the aforementioned objectives, the present disclosure further provides a method for manufacturing a fuse resistor. In this method, an insulation layer is formed to cover a surface of a substrate. A fuse element is formed on a portion of the insulation layer. The fuse element includes a first electrode portion, a melting portion, and a second electrode portion, and the first electrode portion and the second electrode portion are respectively connected to two opposite ends of the melting portion. A protection layer is formed to cover the fuse element and the insulation layer, in which the protection layer has a cavity located on the melting portion. A first electrode is formed to electrically connect with the first electrode portion. A second electrode is formed to electrically connect with the second electrode portion.

According to one embodiment of the present disclosure, the forming of the fuse element includes forming a metal layer on the insulation layer, and removing a portion of the metal layer to define the first electrode portion, the melting portion, and the second electrode portion.

According to one embodiment of the present disclosure, the fuse element is an H-shaped structure.

According to one embodiment of the present disclosure, in the forming of the protection layer, a first insulation film is formed to cover the fuse element and the insulation layer, in which the cavity passes through the first insulation film. A second insulation film is formed to cover the first insulation film, in which the forming of the second insulation film includes sheltering the cavity with the second insulation film.

According to one embodiment of the present disclosure, in the forming of the protection layer, a first dry film layer is formed to cover the fuse element and the insulation layer. A cavity is formed in the first dry film layer, in which the forming of the cavity includes forming the cavity to pass through the first dry film layer to expose the melting portion. A second dry film layer is formed to cover the first dry film layer, in which the forming of the second dry film layer includes sheltering the cavity with the second dry film layer.

According to one embodiment of the present disclosure, in the forming of the cavity, an exposure step is performed on the first dry film layer. A development step is performed on the first dry film layer to remove a portion of the first dry film layer to form the cavity.

BRIEF DESCRIPTION OF THE DRAWINGS

The aforementioned and other objectives, features, advantages, and embodiments of the present disclosure can be more fully understood by reading the following detailed description of the embodiment, with reference made to the accompanying drawings as follows.

DETAILED DESCRIPTION

Figure 1:
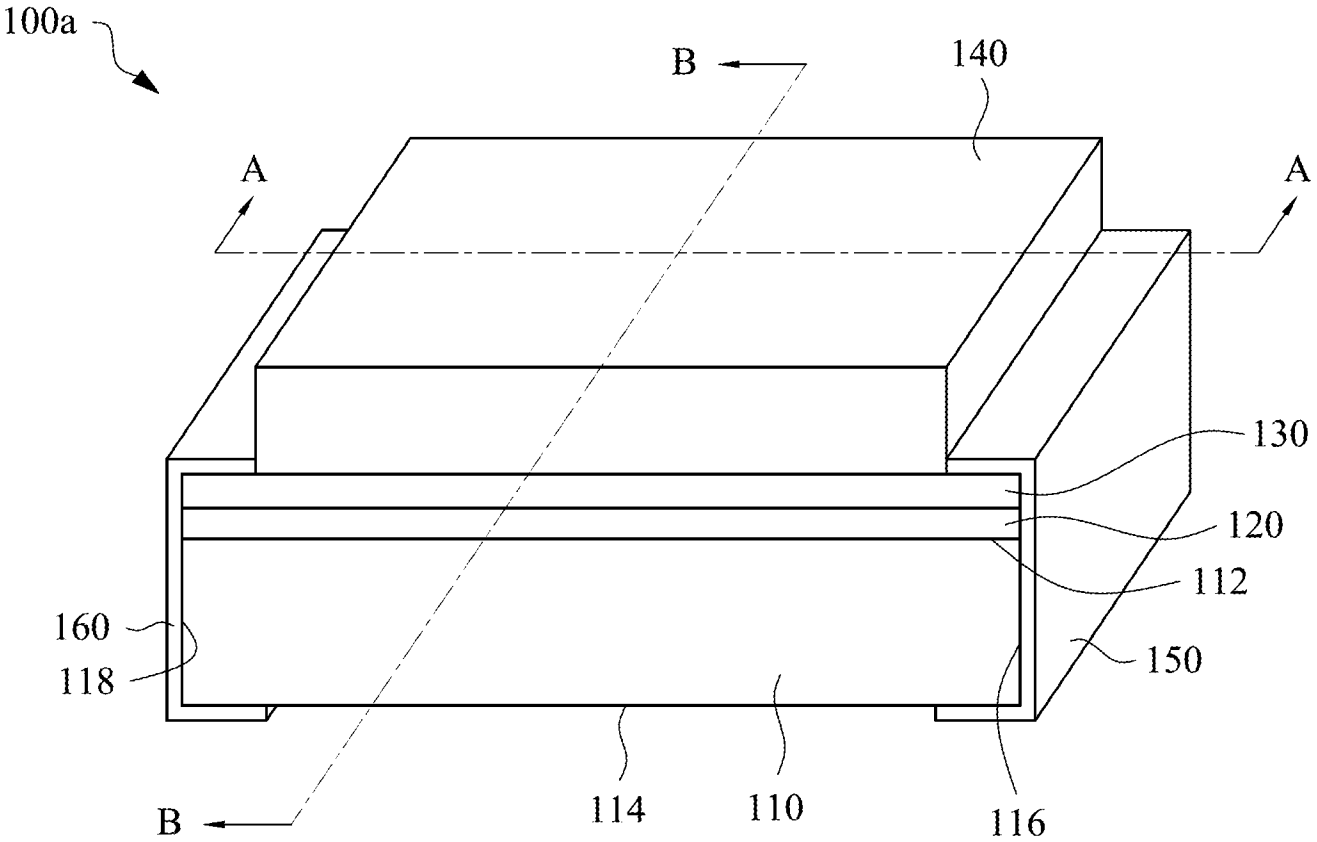
FIG. 1 is a schematic three-dimensional diagram of an fuse resistor in accordance with one embodiment of the present disclosure.

The embodiments of the present disclosure are discussed in detail below. However, it will be appreciated that the embodiments provide many applicable concepts that can be implemented in various specific contents. The embodiments discussed and disclosed are for illustrative purposes only and are not intended to limit the scope of the present disclosure. All of the embodiments of the present disclosure disclose various different features, and these features may be implemented separately or in combination as desired.

In addition, the terms "first", "second", and the like, as used herein, are not intended to mean a sequence or order, and are merely used to distinguish elements or operations described in the same technical terms.

The spatial relationship between two elements described in the present disclosure applies not only to the orientation depicted in the drawings, but also to the orientations not represented by the drawings, such as the orientation of the inversion. Furthermore, the terms "connected", "electrically connected" or the like between two components referred to in the present disclosure are not limited to the direct connection or electrical connection of the two components, and may also include indirect connection or electrical connection as required.

Figure 2:
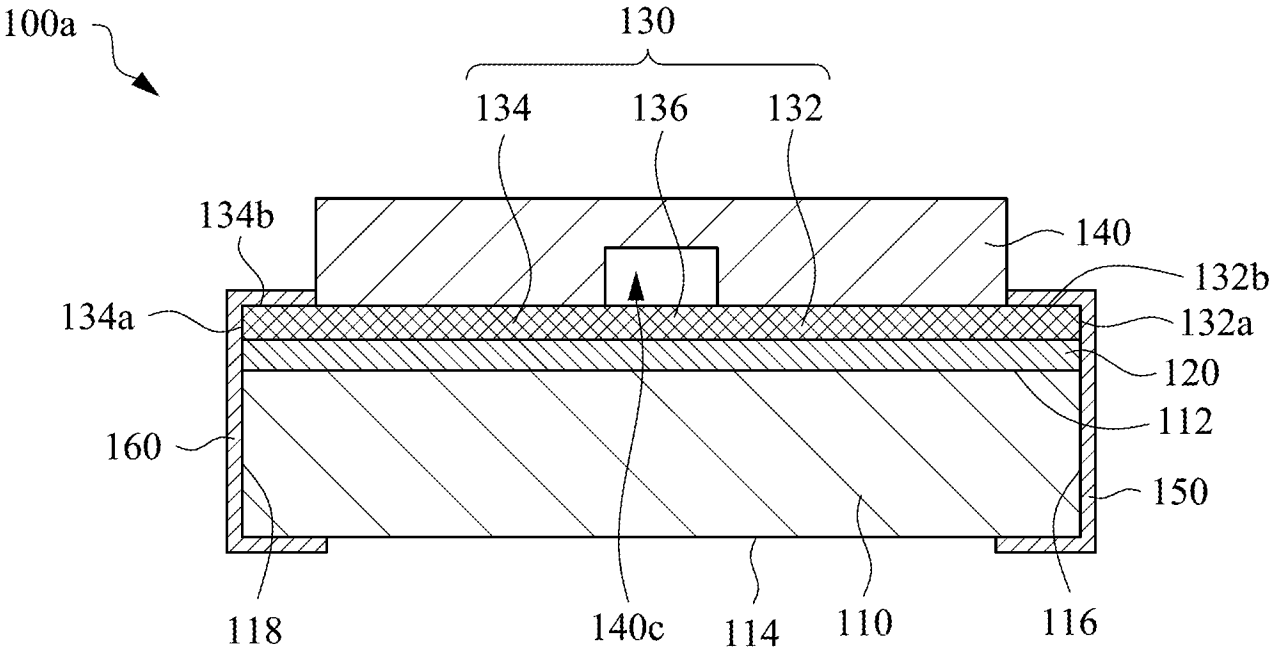
FIG. 2 is a schematic cross-sectional view of the fuse resistor of FIG. 1 along a cross-sectional line A-A.
Figure 3:
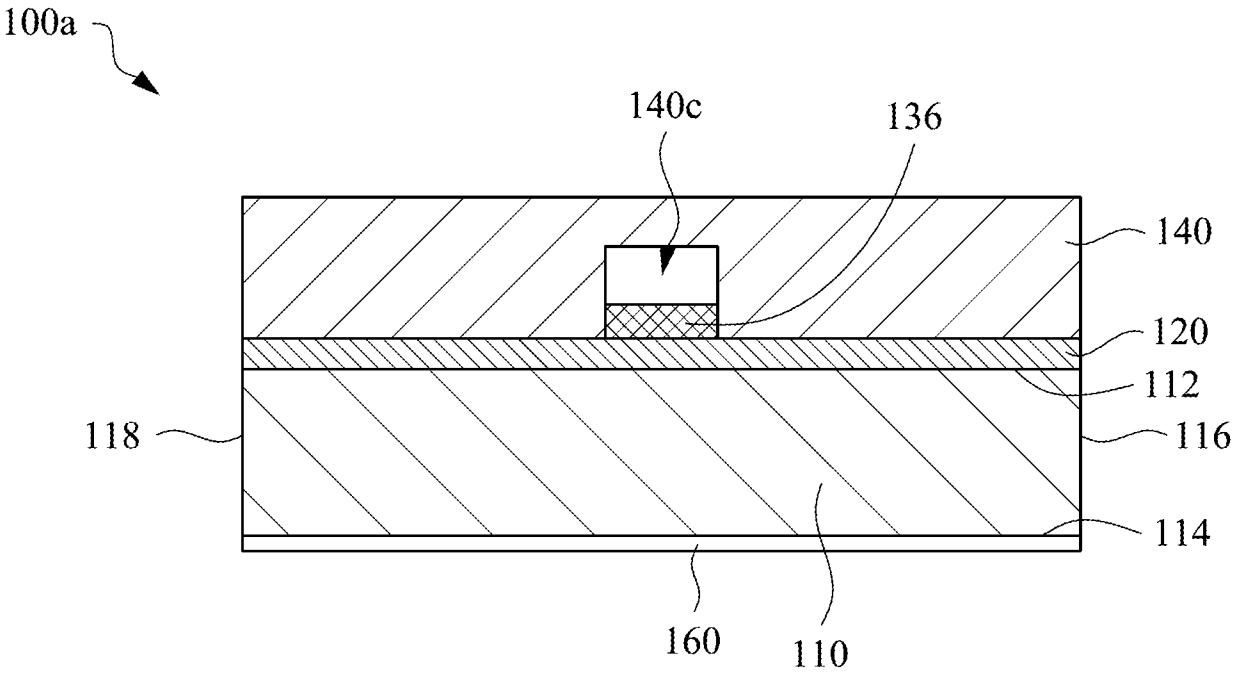
FIG. 3 is a schematic cross-sectional view of the fuse resistor of FIG. 1 along a cross-sectional line B-B.

Referring to FIG. 1 to FIG. 3, FIG. 1 is a schematic three-dimensional diagram of an fuse resistor in accordance with one embodiment of the present disclosure, and FIG. 2 and FIG. 3 are schematic cross-sectional views of the fuse resistor of FIG. 1 along a cross-sectional lines A-A and B-B respectively. In some examples, a fuse resistor 100*a* mainly includes a substrate 110, an insulation layer 120, a fuse element 130, a protection layer 140, a first electrode 150, and a second electrode 160.

The substrate 110 may be a tabulate structure. The substrate 110 may have a first surface 112 and a second surface 114 which are opposite to each other, and a first side surface 116 and a second side surface 118 which are opposite to each other. The first side surface 116 and the second side surface 118 are connected between the first surface 112 and the second surface 114. The substrate 110 may be, for example, a ceramic substrate.

The insulation layer 120 covers the first surface 112 of the substrate 110. For example, the insulation layer 120 covers the entire first surface 112 of the substrate 110. In addition to electrical insulation, the insulation layer 120 preferably has a property of poor thermal conductivity. For example, a thermal conductivity coefficient of the insulation layer 120 may be equal to or smaller than about 0.2 W/mK. In some exemplary examples, a material of the insulation layer 120 includes epoxy.

As shown in FIG. 3, the fuse element 130 is disposed on a portion of the insulation layer 120. The fuse element 130 includes a first electrode portion 132, a second electrode portion 134, and a melting portion 136. The first electrode portion 132 and the second electrode portion 134 are respectively connected to two opposite ends of the melting portion 136. In some exemplary examples, the fuse element 130 is an integral structure. However, the disclosure is not limited thereto, and the fuse element 130 may also be a non-integral structure. A material of the fuse element 130 is a conductive material, such as a metal material. For example, the material of the fuse element 130 is a NiCr alloy, a CuNi alloy, or Cu. The thermal conductivity of the insulation layer 120 is poor, such that heat generated by the fuse element 130 can be concentrated on the melting portion 136 to benefit rapid fuse of the melting portion 136.

Figure 4:
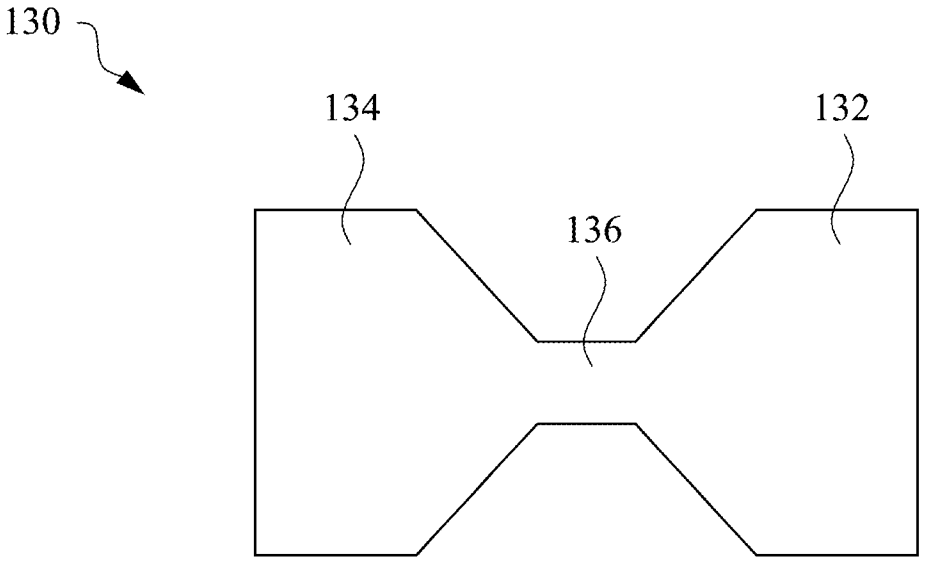
FIG. 4 is a schematic top view of a fuse resistor in accordance with one embodiment of the present disclosure.

Referring to FIG. 4 firstly, FIG. 4 is a schematic top view of a fuse resistor in accordance with one embodiment of the present disclosure. In the present embodiment, the fuse element 130 is an H-shaped structure, and widths of the first electrode portion 132 and the second electrode portion 134, which are located at the two opposite ends of the melting portion 136, are greater than a width of the melting portion 136. The width of the first electrode portion 132 and the width of the second electrode portion 134 are respectively referred to an average width of the first electrode portion 132 and an average width of the second electrode portion 134 herein. The first electrode portion 132 and the second electrode portion 134, which are greater than the melting portion 136, can introduce more current.

The protection layer 140 covers the fuse element 130 and the insulation layer 120. The protection layer 140 can prevent the electrode material from being coated on unexpected areas. In some examples, as shown in FIG. 1 and FIG. 2, the protection layer 140 may cover a portion of the fuse element 130 and a portion of the insulation layer 120. For example, the protection layer 140 covers the entire melting portion 136, but only covers a portion of the first electrode portion 132 and a portion of the second electrode portion 134. The protection layer 140 has a cavity 140*c*, and the cavity 140*c* does not pass through the protection layer 140. The cavity 140*c* is located on the melting portion 136 of the fuse element 130. For example, the cavity 140*c* is aligned with the melting portion 136 and is located directly above the melting portion 136. Thus, the protection layer 140 and the melting portion 136 can collectively define a hollow air chamber space.

In some examples, as shown in FIG. 2 and FIG. 3, the protection layer 140 may be a single-layered structure. In some exemplary examples, the protection layer may be a multi-layered stack structure, for example, a double-layered stack structure, such as a protection layer 170 shown in FIG. 5E. A material of the protection layer 140 may be selected from electrically insulated materials with poor thermal conductivity. For example, a thermal conductivity coefficient of the protection layer 140 may be equal to or smaller than 0.2 W/mK. The material of the protection layer 140 may include epoxy. In some exemplary examples, the material of the protection layer 140 may be a dry film, for example.

The protection layer 140 has the cavity 140*c* on the melting portion 136 to form the hollow air chamber. In addition, the cavity 140*c* does not pass through the protection layer 140. Thus, spark and/or residues generated during a fusing process of the melting portion 136 of the fuse element 130 can be confined within the hollow air chamber without leaking or splashing, such that other devices are not damaged. Furthermore, with the existing of the cavity 140*c*, the melting portion 136 is not covered directly by the protection layer 140 to provide a fusing space for the melting portion 136, such that a fusing speed of the fuse element 136 is increased.

The first electrode 150 is electrically connected to the first electrode portion 132 of the fuse element 130. In some examples, the first electrode 150 at least covers a side surface 132*a* of the first electrode portion 132 and the first side surface 116 of the substrate 110. That is, the side surface 132*a* of the first electrode portion 132 and the first side surface 116 of the substrate 110 are located at the same side, and the first electrode 150 at least extends from the side surface 132*a* of the first electrode portion 132 to the first side surface 116 of the substrate 110. In some exemplary examples, as shown in FIG. 2, the first electrode 150 covers a top surface 132*b* and the side surface 132*a* of the first electrode portion 132, and the first side surface 116 and a portion of the second surface 114 of the substrate 110 to form an inverted C-shaped structure. A material of the first electrode 150 may be metal, such as Cu or a Cu alloy.

The second electrode 160 is electrically connected to the second electrode portion 134 of the fuse element 130. In some examples, the second electrode 160 at least covers a side surface 134*a* of the second electrode portion 134 and the second side surface 118 of the substrate 110. That is, the side surface 134*a* of the second electrode portion 134 and the second side surface 118 of the substrate 110 are located at the same side, and the second electrode 160 at least extends from the side surface 134*a* of the second electrode portion 134 to the second side surface 118 of the substrate 110. In some exemplary examples, as shown in FIG. 2, the second electrode 160 covers a top surface 134*b* and the side surface 134*a* of the second electrode portion 134, and the second side surface 118 and a portion of the second surface 114 of the substrate 110 to form a C-shaped structure. A material of the first electrode 160 may be metal, such as Cu or a Cu alloy.

Figure 5A:
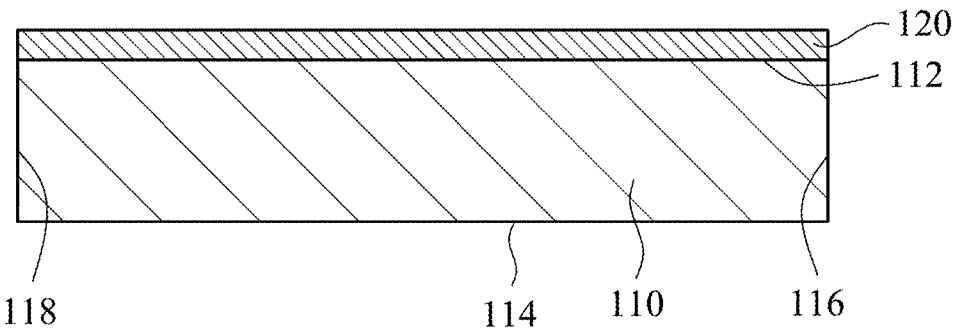
FIG. 5A to FIG. 5E are schematic partial cross-sectional views of various intermediate stages showing a method for manufacturing a fuse resistor in accordance with one embodiment of the present disclosure.
Figure 5B:
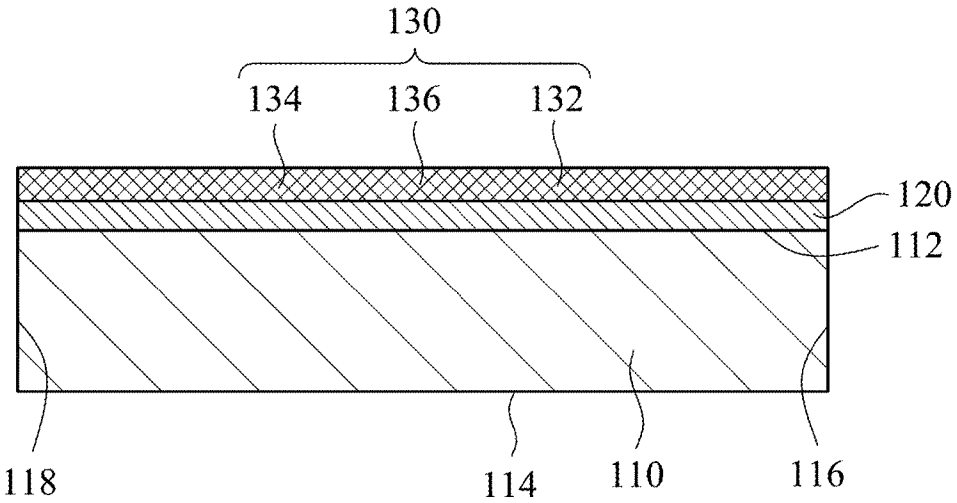
Figure 5C:
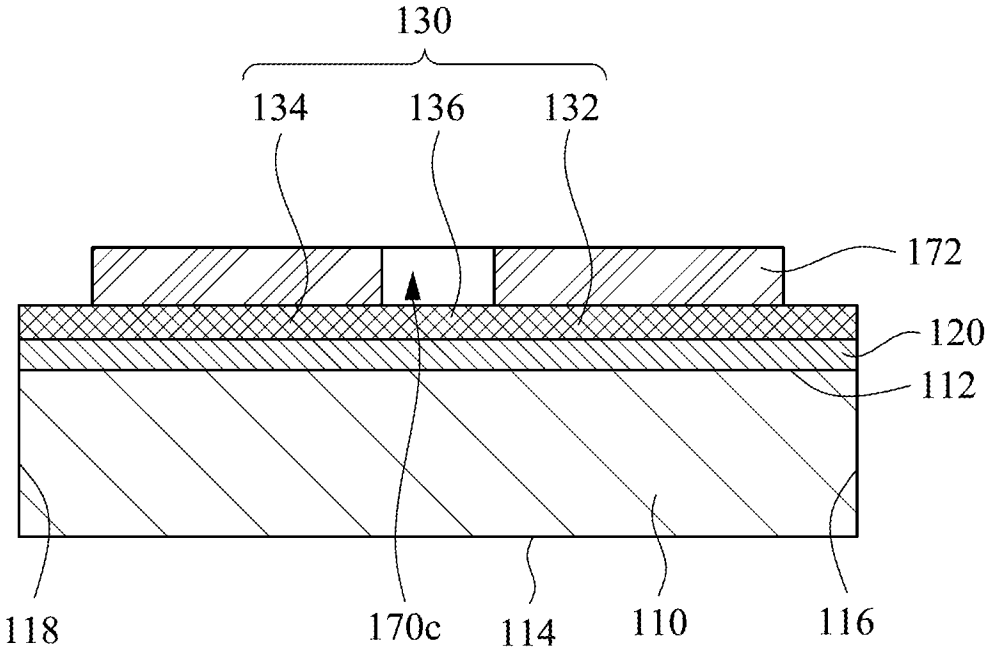
Figure 5D:
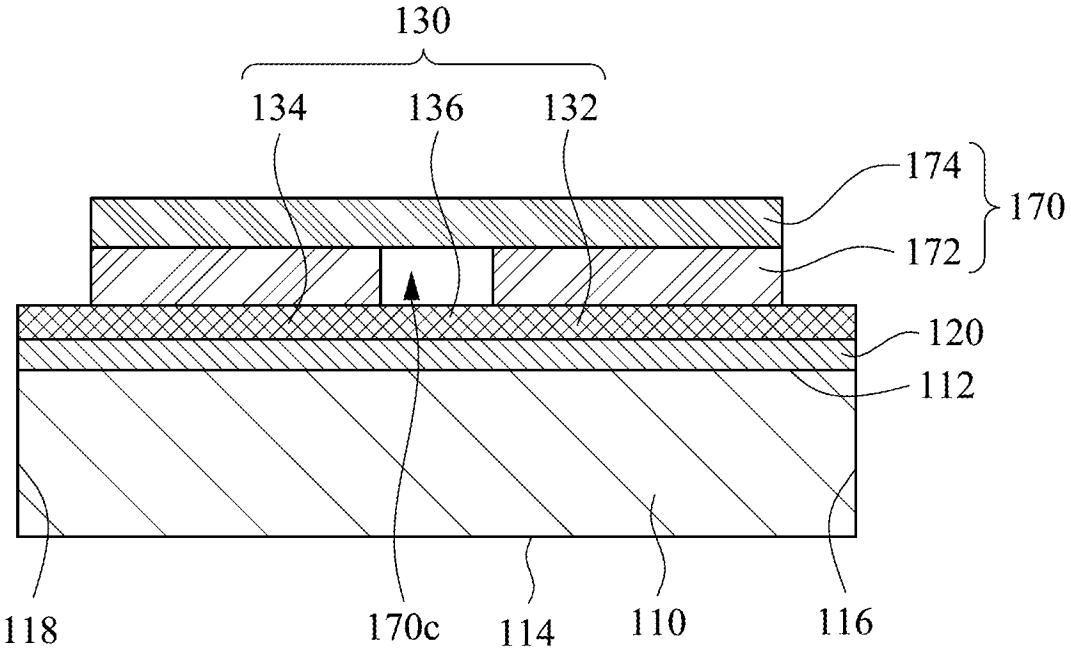
Figure 5E:
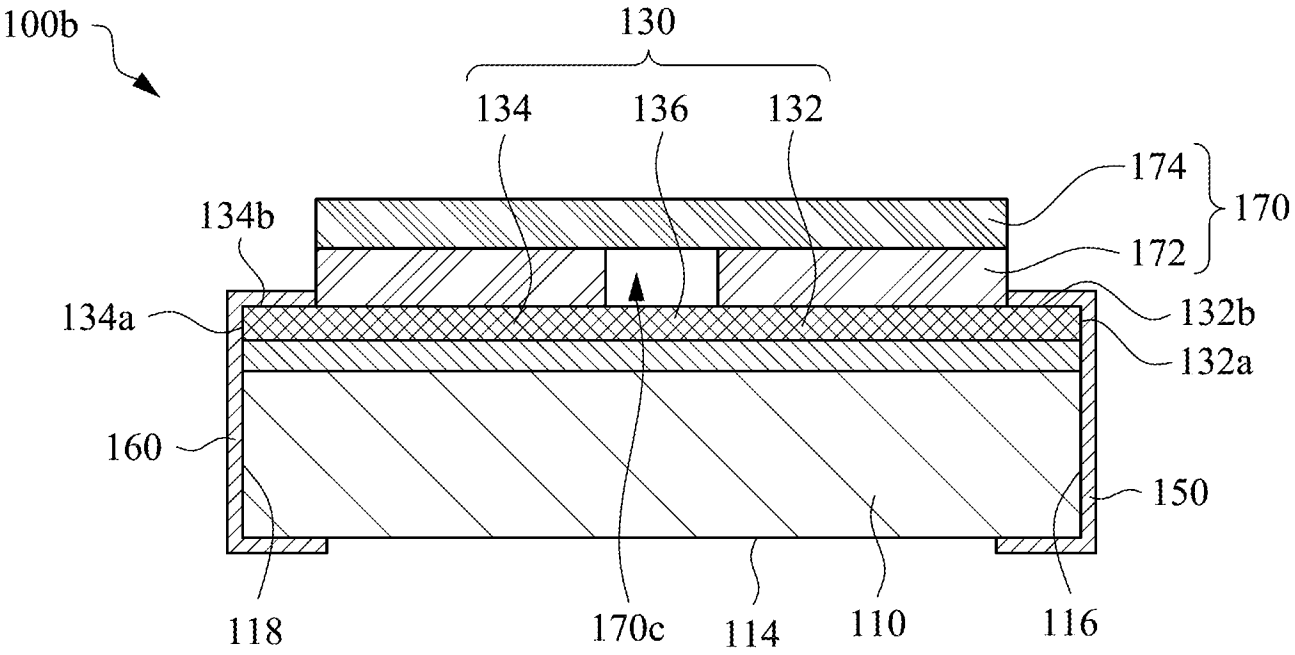

Referring to FIG. 5A to FIG. 5E, FIG. 5A to FIG. 5E are schematic partial cross-sectional views of various intermediate stages showing a method for manufacturing a fuse resistor in accordance with one embodiment of the present disclosure. In the manufacturing of a fuse resistor 100*b* as shown in FIG. 5E, a substrate 110 may be provided firstly, and an insulation layer 120 is formed to cover a first surface 112 of the substrate 110 by using, for example coating method or a printing method, as shown in FIG. 5A. The insulation layer 120 may cover the entire first surface 112 of the substrate 110, or may cover a portion of the first surface 112 of the substrate 110. The structures and the material properties of the substrate 110 and the insulation layer 120 have been described above, and are not repeated herein.

As shown in FIG. 5B, after the insulation layer 120 is disposed, a fuse element 130 may be formed on a portion of the insulation layer 120. The fuse element 130 includes a first electrode portion 132, a melting portion 136, and a second electrode portion 134, in which the first electrode portion 132 and the second electrode portion 134 are respectively connected to two opposite ends of the melting portion 136. The fuse element 130 may be a non-integral structure. In some exemplary examples, the fuse element 130 is an integral structure. In addition, in the manufacturing of the fuse element 130, a metal layer may be formed on the insulation layer 120 by using, for example, a sputtering method or other common deposition methods. A portion of the metal layer is removed by using, for example, an etching method, to define locations and shapes of the first electrode portion 132, the melting portion 136, and the second electrode portion 134, so as to complete the manufacturing of the fuse element 130. For example, as shown in FIG. 4, the fuse element 130 may be an H-shaped structure, i.e. a width of the melting portion 136, which is located between the first electrode portion 132 and the second electrode portion 134, is smaller than a width of the first electrode portion 132 and a width of the second electrode portion 134. The material property of the fuse element 130 has been described above, and is not repeated herein.

Then, a protection layer 170 may be formed to cover the fuse element 130 and an exposed portion of the insulation layer 120. For example, as shown in FIG. 5D, the protection layer 170 covers the entire melting portion 136, but only covers a portion of the first electrode portion 132 and a portion of the second electrode portion 134. The protection layer 170 has a cavity 170*c*, in which the cavity 170*c* is formed on the melting portion 136. For example, the cavity 170*c* may be aligned with the melting portion 136 and may be located directly above the melting portion 136.

The protection layer 170 of the present embodiment is a double-layered stack structure. In some examples, in the manufacturing of the protection layer 170, a first insulation film 172 may be firstly formed to cover the fuse element 130 and the insulation layer 120. The first insulation film 172 has the cavity 170*c*, and the cavity 170*c* passes through the first insulation film 172 to form a through hole. As shown in FIG. 5C, the cavity 170*c* of the first insulation film 172 exposes the melting portion 136 of the fuse element 130. Before the first insulation film 172 is disposed on the fuse element 130 and the insulation layer 120, the cavity 170*c* may have been formed in the first insulation film 172. In some exemplary examples, in the forming the first insulation film 172 on the insulation layer 120, an insulation material film may be firstly disposed to cover the fuse element 130 and the insulation layer 120, and then a portion of the insulation material film may be removed by using a photolithography process, or a photolithography process and an etching process, so as to form the first insulation film 172 having the cavity 170*c* on the insulation layer 120.

Next, as shown in FIG. 5D, a second insulation film 174 is formed to cover the first insulation film 172, in which the second insulation film 174 shelters the cavity 170*c* in the first insulation film 172. Thus, the second insulation film 174, the first insulation film 172, and the melting portion 136 can collectively define a hollow air chamber. For example, the second insulation film 174 may be a solid state structure, and may be disposed on the first insulation film 172 before the first insulation film 172 is solidified completely. Thus, after the first insulation film 172 is solidified, the second insulation film 174 may be adhered to the first insulation film 172. A material of the first insulation film 172 may be the same as or may be different from that of the second insulation film 174. For example, the material of the first insulation film 172 may be photoresist to benefit the forming of the cavity 170*c*, and the material of the second insulation film 174 may not be photoresist and may be an insulation material with poor thermal conductivity. For example, thermal conductivity coefficients of the first insulation film 172 and the second insulation film 174 may be equal to or smaller than 0.2 W/mK. The materials of the first insulation film 172 and the second insulation film 174 may include epoxy.

In some exemplary examples, the first insulation film 172 and the second insulation film 174 may be respectively a first dry film layer and a second dry film layer. In the forming of the protection layer 170, the first insulation film 172 made of a dry film may be firstly formed to cover the fuse element 130 and the insulation layer 120. Then, the cavity 170*c* may be formed in the first insulation film 172. The first insulation film 172 is a dry film layer, such that in the forming of the cavity 170*c*, an exposure step may be firstly performed on the first insulation film 172, and then a development step may be performed on the first insulation film 172 to remove the dry film layer on the melting portion 136, so as to form the cavity 170*c* in the first insulation film 172. Subsequently, before the dry film of the first insulation film 172 is solidified, the second insulation film 174 made of a solid state dry film is disposed on the first insulation film 172 to cover the first insulation film 172 and to shelter the cavity 170*c*. After the first insulation film 172 is solidified, the protection layer 170 including a double-layered stack structure is completed.

After the protection layer 170 is completed, a first electrode 150 may be formed to electrically connect with the first electrode portion 132 of the fuse element 130 by using, for example, a sputtering process. The first electrode 150 at least covers a side surface 132*a* of the first electrode portion 132 and a first side surface 116 of the substrate 110. In some exemplary examples, as shown in FIG. 5E, the first electrode 150 covers a top surface 132*b* and the side surface 132*a* of the first electrode portion 132, and the first side surface 116 and a portion of a second surface 114 of the substrate 110. The material property of the first electrode 150 has been described above, and is not repeated herein.

Similarly, a second electrode 160 may be formed to electrically connect with the second electrode portion 134 of the fuse element 130 to complete the formation of the fuse resistor 100*b* by using, for example, a sputtering process. The second electrode 160 at least covers a side surface 134*a* of the second electrode portion 134 and the second side surface 118 of the substrate 110. In some exemplary examples, as shown in FIG. 5E, the second electrode 160 covers a top surface 134*b* and the side surface 134*a* of the second electrode portion 134, and the second side surface 118 and a portion of the second surface 114 of the substrate 110. The material property of the second electrode 160 has been described above, and is not repeated herein.

The above embodiment is related to the manufacturing of the fuse resistor 100*b* including the protection layer 170, which is a double-layered stack structure, the method of the present disclosure may be also applied to the manufacturing of the fuse resistor 100*a* including the single-layered protection layer 140. Referring to FIG. 2 and FIG. 3 again, after the fuse element 130 is formed on the insulation layer 120, the protection layer 140, in which the cavity 140*c* has been formed, may be provided, and then the protection layer 140 may be fixed on the fuse element 130 and the insulation layer 120. In the disposing of the protection layer 140, the cavity 140*c* is aligned with the melting portion 136 of the fuse element 130, such that the protection layer 140 and the melting portion 136 can collectively define a hollow air chamber. Subsequently, the first electrode 150 and the second electrode 160 are formed to complete the manufacturing of the fuse resistor 100*a*. The manufacturing of the insulation layer 120, the fuse element 130, the first electrode 150, and the second electrode 160 may be similar to the aforementioned embodiment, and is not repeated herein.

According to the aforementioned embodiments, one advantage of the present disclosure is that a protection layer covering a fuse element of the present disclosure has a cavity on a melting portion of the fuse element, such that a fusing speed of the fuse element is increased to effectively protect other electronic devices on a circuit board.

According to the aforementioned embodiments, another advantage of the present disclosure is that there is a hollow air chamber between the melting portion of the fuse element and the protection layer, such that splashing of spark and/or residues generated during a rapid fusing process of the melting portion can be confined to prevent peripheral devices from being affected and damaged during rapid fusing.

Although the present disclosure has been described in considerable details with reference to certain embodiments, the foregoing embodiments of the present disclosure are illustrative of the present disclosure rather than limiting of the present disclosure. It will be apparent to those having ordinary skill in the art that various modifications and variations can be made to the present disclosure without departing from the scope or spirit of the disclosure. Therefore, the spirit and scope of the appended claims should not be limited to the description of the embodiments contained herein.

What is claimed is:

1. A method for manufacturing a fuse resistor, comprising:

forming an insulation layer to cover a surface of a substrate;

forming a fuse element on a portion of the insulation layer, wherein the fuse element comprises a first electrode portion, a melting portion, and a second electrode portion, and the first electrode portion and the second electrode portion are respectively connected to two opposite ends of the melting portion;

forming a protection layer to cover the fuse element and the insulation layer, wherein the protection layer has a cavity located on the melting portion, and forming the protection layer comprises:

forming a first insulation film, wherein forming the first insulation film comprises forming an insulation material film to cover the fuse element and the insulation layer, and removing a portion of the insulation material film to form the first insulation film having the cavity, and wherein the cavity passes through the first insulation film to expose the melting portion; and forming a second insulation film on another portion of the first insulation film and covering the first insulation film after the cavity is formed, wherein forming the second insulation film comprises sheltering the cavity with the second insulation film;

forming a first electrode to electrically connect with the first electrode portion; and forming a second electrode to electrically connect with the second electrode portion.

2. The method of claim 1, wherein forming the fuse element comprises:

forming a metal layer on the insulation layer; and removing a portion of the metal layer to define the first electrode portion, the melting portion, and the second electrode portion.

3. The method of claim 1, wherein the fuse element is an H-shaped structure.

4. The method of claim 1, wherein forming the protection layer comprises:

forming a first dry film layer as the first insulation film;

forming a cavity in the first dry film layer, wherein forming the cavity comprises forming the cavity to pass through the first dry film layer to expose the melting portion; and forming a second dry film layer as the second insulation film to cover the first dry film layer, wherein forming the second dry film layer comprises sheltering the cavity with the second dry film layer.

5. The method of claim 4, wherein forming the cavity comprises:

performing an exposure step on the first dry film layer; and performing a development step on the first dry film layer to remove a portion of the first dry film layer to form the cavity.

* * * * *